United States Patent [19]

Carey

[11] Patent Number: 4,538,134

[45] Date of Patent: Aug. 27, 1985

[54] CONTROL APPARATUS

[76] Inventor: John C. Carey, Box 1143, Glasgow, Mont. 59230

[21] Appl. No.: 595,549

[22] Filed: Mar. 30, 1984

Related U.S. Application Data

[63] Continuation-in-part of Ser. No. 366,042, Apr. 29, 1982, abandoned.

[51] Int. Cl.[3] ..... H01H 37/04

[52] U.S. Cl. ..... 337/113; 337/3; 337/381

[58] Field of Search ..... 337/381, 380, 113, 112, 337/3

[56] References Cited

U.S. PATENT DOCUMENTS 3,546,650 12/1970 Purer ..... 337/113

*Primary Examiner*—Harold Broome

*Attorney, Agent, or Firm*—Arthur L. Urban

[57] ABSTRACT

Temperature responsive control apparatus including a housing portion, a socket portion, a circuit portion, a temperature responsive portion, a connecting portion and a fastening portion; the housing portion including an enclosure member including a major face section, sidewall sections and a cover section forming a chamber; the socket portion including a plurality of openings in the enclosure member, the openings being arranged into groups of at least two adjacent openings with each group providing a combination of openings mateable with an electrical plug member; the circuit portion including at least two spaced buss bar members, each of the buss bar members including a contact section adjacent each end thereof extending in one direction therefrom toward the socket openings and terminating adjacent thereto, one of the contact sections that extends from one of the buss bar members being disposed adjacent a socket opening of each socket opening group and one of the contact sections that extends from another buss bar member being disposed adjacent a second socket opening of each socket opening group, the temperature responsive portion including a bi-metal thermostat disposed within the chamber and having one contact thereof connected to one of the buss bar members; the connecting portion including positive and neutral contact terminals, a contact terminal extending from one of the buss bar members, and another of the contact terminals extending from a second contact of the bi-metal thermostat.

15 Claims, 8 Drawing Figures

FIG. 1
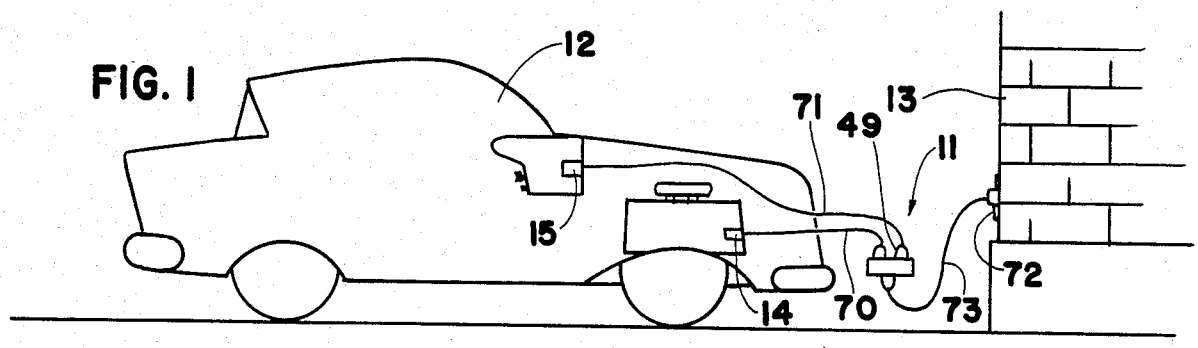
FIG. 2
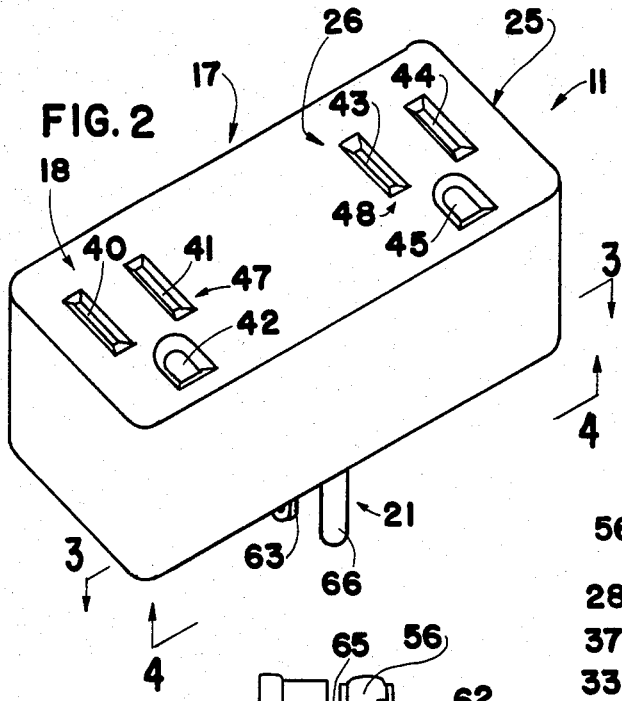
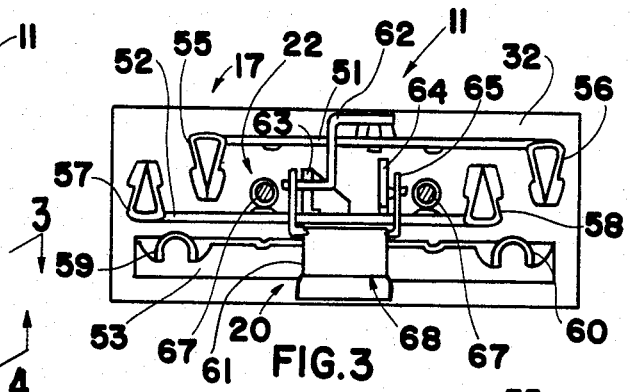
FIG. 3
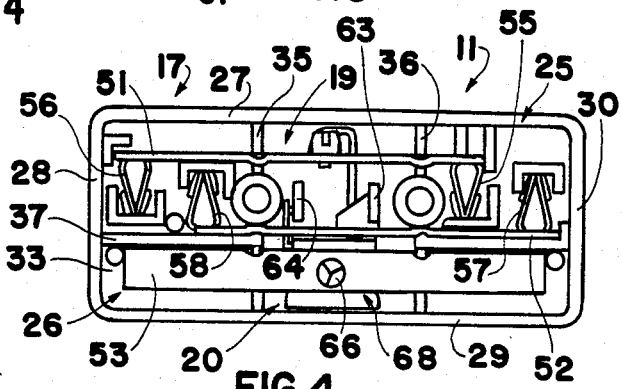
FIG. 4
FIG. 5
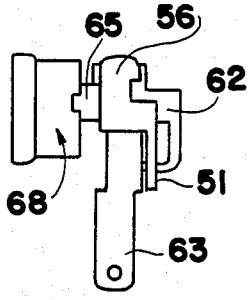
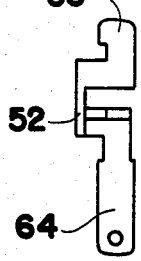
FIG. 6
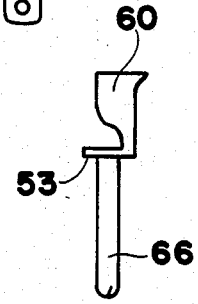
FIG. 7
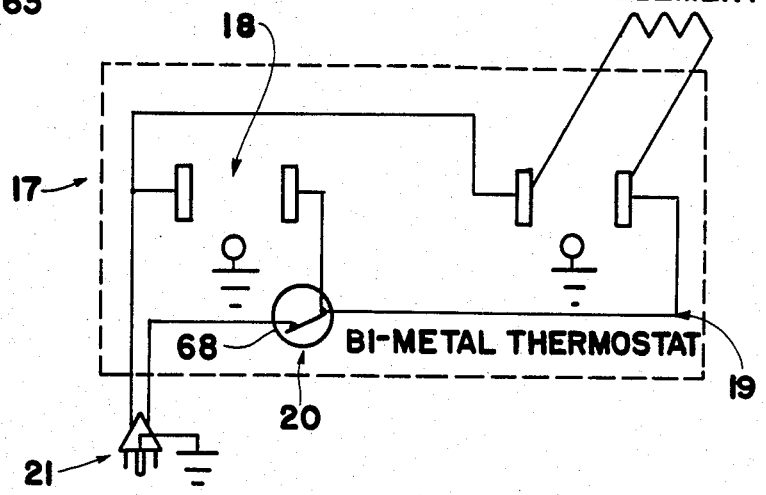
FIG. 8

CONTROL APPARATUS

This application is a continuation-in-part of pending application Ser. No. 366,042, filed 29, 1982 and now abandoned.

This invention relates to a novel control apparatus and more particularly relates to a new control apparatus for electrical devices.

Society utilizes a wide variety of different electrical devices every day. Some of these devices are operated only on an intermittent basis and normally are activated by a switch of some type. With devices that are inexpensive, activation of the device usually is accomplished with a simple manual switch.

Manual switches on electrical devices and appliances ordinarily are satisfactory when the user must be present during the operation thereof. Examples of such devices include hair dryers, shavers, blenders and the like.

However, with some electrical devices it sometimes is desirable to operate them when no one is present. Examples are ovens, hot water heaters, etc. Such devices normally are equipped with timers or temperature controls that can be set to activate the device when a preselected time or temperature is achieved. However, such controls add significantly to the cost of the item and therefore devices equipped in this way may not even be available to the consumer.

One manually operated electrical device widely used by vehicle owners particularly in cold climates is the engine heater. Such heaters are used in cold weather to maintain the engine and its components at a temperature above ambient temperature. This is done to facilitate starting of the engine when the vehicle has been standing outside in cold weather.

If the engine is not maintained at a temperature above ambient in extremely cold weather, the oil and other fluids in the engine and its accessories may become very viscous. This increase in viscosity of the fluids can make it difficult to move the working parts of the engine and thus the engine cannot be started. A further complication is the fact that the battery cannot deliver electrical energy to the starter as effectively in very cold weather.

To minimize increases in the viscosity of oil and other fluids as the temperature drops, multi-grade oils and fluids have been developed. These formulations are designed to provide a low viscosity, e.g. 10 at low temperatures and a high viscosity, e.g. 40 at higher temperatures. While the use of such multi-grade oils does benefit engine starting at low temperatures, when the temperature drops drastically, it still may not be possible to start an engine.

Because of these winter engine starting problems, engine heaters have become popular in cold weather climates. The heaters are of two general types—plug heaters which are inserted through a plug opening in the engine or tank or hose heaters that are inserted along the length of a water hose of the engine.

In the use of such engine heaters, the vehicle owner connects the heater cord to a power supply such as an electrical circuit of a building. The owner does this when he wishes to start his vehicle engine. However, since it takes some time for the heater to warm the engine, the heater must be activated at a time prior to that when the owner wishes to start the engine.

Selecting the proper time to activate the heater can present problems. If an owner will not use his vehicle until late in the day, he can simply activate the heater a few hours before he wants to start the engine. However, if the owner wishes to use the vehicle early in the morning, he either has to awaken several hours early or he has to activate the heater before he goes to bed the night before. The latter procedure is most common since very few owners are willing to interrupt thier sleep just to activate the heater in the middle of the night.

When electrical energy was relatively inexpensive, most people did not mind the relatively small additional energy cost to insure that their vehicle engines would start easily even in very cold weather. However, with the very large increases in the cost of electrical energy in recent years, people have become much more conscious of energy conservation and carefully watch their use of energy. As a result, individuals now more fully realize the cost of using an engine heater and are trying to reduce the amount of time that they use the heater.

Whereas persons formerly activated their engine heaters each night during the cold season, now they are monitoring weather forecasts more closely to determine if they can avoid the use of the heater on certain days and nights. While in theory this procedure appears to be an acceptable solution, in practice it leaves much to be desired.

Since it is impossible to predict the weather with certainty, if the vehicle owner does not activate the heater he is taking a chance that the weather will be much colder than predicted. Should this occur, he may not be able to start his vehicle in the morning when he needs to go to work or take care of some other very important task. On the other hand, if the owner activates the heater and the weather unexpectedly turns warmer than predicted, the owner will have wasted electrical energy in heating the engine when it was not necessary.

From the above discussion, it is evident that engine heaters presently available do not provide a satisfactory solution in many engine heating situations. Thus, there is a need for a control apparatus that can overcome the shortcomings of current heaters as well as other manually operated electrical devices such as fans, space heaters and the like, the operation of which is determined by changes in ambient temperature conditions.

The present invention provides a novel control apparatus for electrical devices. The apparatus of the invention provides a means for overcoming the problems encountered with excess operation of such devices. The control apparatus confines operation thereof to situations in which the device actually is required. The apparatus automatically controls the operation of the device.

The control apparatus of the invention insures that an electrical device does not operate unnecessarily. As a result, the control apparatus minimizes the electrical energy used and thereby significantly reduces the cost of operation and increases the life of the device.

The control apparatus of the present invention is simple is design and relatively inexpensive. The apparatus can be fabricated from commercially available materials and components. Conventional electrical device manufacturing techniques and procedures can be utilized in its fabrication. The apparatus is durable in construction and has a long useful life with a minimum of maintenance.

The control apparatus of the present invention can be installed by persons with limited mechanical aptitude and/or experience. The installation can be completed in a short period of time after a minimum of instruction. A wide variety of different electrical devices can be modified simply and conveniently by most individuals. The apparatus can be employed with a single unit or to control the operation of several devices simultaneously.

These and other benefits and advantages of the novel control apparatus of the present invention will be apparent from the following description and the accompanying drawings in which:

FIG. 1 is a schematic illustration partially in section of one form of temperature responsive control apparatus of the invention in use with vehicle heaters;

FIG. 2 is an enlarged view in perspective of the temperature responsive control apparatus shown in FIG. 1;

FIG. 3 is a sectional view of the temperature responsive control apparatus shown in FIG. 2 taken along line 3—3 thereof;

FIG. 4 is a sectional view of the temperature responsive control apparatus shown in FIG. 2 taken along line 4—4 thereof;

FIG. 5 is a right end view of a buss bar member and thermostat of the temperature responsive control apparatus shown in FIG. 3;

FIG. 6 is a right end view of another buss bar member of the temperature responsive control apparatus shown in FIG. 3.

FIG. 7 is a right end view of a third buss bar member of the temperature responsive control apparatus shown in FIG. 3; and FIG. 8 is a schematic illustration of one form of circuitry of the temperature responsive control apparatus of the invention.

As shown in the drawings, one form of the novel temperature responsive control apparatus 11 of the present invention is shown in use with a vehicle 12. The control apparatus 11 is connected electrically to at least one heating element mounted in the vehicle and to an electrical circuit of a building 13.

The heating element may be an engine heating element 14 such as a plug heater or a passenger compartment heating element 15. The engine heating element 14 may be a commerically available unit commonly employed to heat the engine to facilitate starting thereof in cold weather. The interior heating element 15 also may be a commercially available unit that is utilized to keep the passenger compartment of the vehicle at a comfortable temperature during storage in cold weather so it will not be cold when the driver enters.

The temperature responsive control apparatus 11 of the invention includes a housing portion 17, a socket portion 18, a circuit portion 19, a temperature responsive portion 20, a connecting portion 21 and a fastening portion 22.

The housing portion 17 of the control apparatus 11 includes an enclosure member 25. The enclosure member 25 includes a major face section 26 and a plurality of sidewall sections 27, 28, 29 and 30. The sidewall section 27–30 extend from edges of the face section 26. A cover section 32 joins the free edges of the sidewall sections to form a chamber 33 with the enclosure member 25.

The enclosure member 25 also includes a plurality of divider sections 35, 36 and 37. The divider sections 35–37 extend from the face section 26 and the sidewall sections 27–30 toward the cover section 32. Advantageously, the housing portion is formed of plastic. The enclosure member 25 preferably is a unitary structure, particularly of a quadrangular configuration.

The socket portion 18 of the control apparatus 11 includes a plurality of adjacent cooperating openings 40, 41, 42, 43, 44 and 45 in major face section 26 of the enclosure member 25. The openings 40–45 are arranged into groups 47 and 48 with at least two and advantageously three adjacent openings, that is, openings 40–42 in group 47 and openings 43–45 in group 48. Each group 47 and 48 provides a combination of openings mateable with an electrical plug member 49. The socket openings of each group preferably are arranged in a triangular configuration.

The circuit portion 19 of the control apparatus 11 includes at least two and advantageously three spaced buss bar members 51, 52 and 53. The buss bar members are disposed within the chamber 33 of the enclosure member 25 in a generally parallel relationship. Preferably, the buss bar members are retained in position through divider sections 35–37. Each of the buss bar members 51–53 includes a pair of contact sections 55, 56, 57, 58, 59 and 60. The contact sections are disposed adjacent each end of the respective buss bar members.

The contact sections 55–60 extend from the buss bar members in one direction toward the socket openings and terminate adjacent thereto. One of the contact sections, e.g. 55, of one of the buss bar members 51 is disposed adjacent a socket opening 40 of socket opening group 47. Likewise, one of the contact sections 56 that extends from another buss bar member 52 is disposed adjacent a second socket opening 41 of the same group 47. Similarly, contact section 57 of buss bar member 53 is disposed adjacent a third socket opening 42 of the group 47.

In this way, the three contact sections 55, 56 and 57 of socket opening group 47 extend from three different buss bar members 51, 52 and 53 so a plug member 49 of the conventional three prong configuration can be inserted in the socket openings 40, 41 and 42 of socket group 47 to provide positive, neutral and ground connections simultaneously.

The temperature responsive portion 20 of the control apparatus 11 includes a bi-metal thermostat means 68. The bi-metal thermostat 68 is disposed within the chamber 33 of the enclosure member 25. The bi-metal thermostat 68 advantageously includes an insulator housing 61. The bi-metal thermostat has one contact 62 thereof connected to one of the buss bar members (buss bar 51).

The connecting portion 21 of the control apparatus 11 of the invention includes positive and neutral contact terminals 63 and 64, respectively. Contact terminal 63 extends from a second contact 65 of the bi-metal thermostat 68. Another contact terminal 64 extends from one of the buss bar members 52. A third ground terminal 66 preferably extends from the third buss bar member 53.

The contact and ground terminals advantageously extend through the cover section 32. Preferably, the contact terminals 63 and 64 have blade configurations and the ground terminal 66 is an elongated cylindrical pin. When the contact terminals 63 and 64 are blades, it is preferred that they be arranged substantially parallel to each other.

The fastening portion 22 of the apparatus 11 includes fasteners that secure the cover section 32 to the enclosure member 25. Advantageously, the fasteners include screws 67 which extend through the cover section into the divider sections 35 and 36 of the enclosure member.

In the use of the control apparatus 11 of the present invention, one or more heating elements are installed in the vehicle 12 (FIG. 1). An engine heating element 14 can be installed in the engine in the same way as with conventional engine heaters. The heating element may be installed in an engine plug opening or by inserting along a liquid circulating hose. Also, a passenger compartment heating element 15 can be installed in the vehicle interior. Cords or wires 70 and 71 from the respective heating elements are connected into the socket groups 47 and 48 of the control apparatus 11 which is located outside the vehicle in the ambient atmosphere.

In the same way, the control apparatus 11 is connected to an electrical current supply. As shown, the control apparatus is connected to an electrical circuit 72 of a building 13 through a suitable extension cord 73 or by plugging terminals 63–65 directly into the circuit. The control apparatus 11 is now ready for use.

The control apparatus 11 automatically heats the vehicle 12 without any attention from the owner. Thus, if the weather turns cold such as a temperature drop at night, the bi-metal thermostat 68 of the control apparatus will close the circuit (FIG. 8) through the apparatus 11 allowing electrical current to pass from the circuit 72 of the building 13 to the heating elements 14 and 15. In this way, the vehicle 12 will be heated properly when the owner is ready to use it. The vehicle engine will start easily since it is warm. Also, the interior of the vehicle will be warm for the driver and any passengers.

On the other hand, if the ambient temperature remains at a level in which the vehicle engine will start easily, the bi-metal thermostat 68 of the control apparatus 11 will remain open so that electrical current will not activate the heating elements 14 and 15. Advantageously, the bi-metal thermostat for vehicle heating closes at a temperature between about 0° and 20° F.

Thus, the control apparatus 11 provides heat when the ambient temperature drops below a minimum threshold temperature but does not waste electrical energy to heat the vehicle when it is not necessary. All of this is done automatically without requiring the attention of the owner or other persons.

In addition to the use of the control apparatus 11 in combination with heating elements for vehicles, the control apparatus also can be employed with a wide variety of different electrical devices and appliances that are operated in response to changes in ambient temperatures. Examples of other heaters include space heaters for greenhouses, animal barns, pump houses, incubators, root cellars, etc.; liquid heaters such as livestock watering tanks, heating tapes for water pipes and the like. The control apparatus is useful also with fans such as attic fans, wood stove fans, etc. which circulate warm or hot air. The control apparatus is employed in the manner described above with the operating range of the bi-metal thermostat being selected for the specific temperature conditions to be encountered.

The above description and the accompanying drawings show that the present invention provides a novel control apparatus. The apparatus of the invention minimizes the electrical energy used and thus significantly reduces the operating cost of electrical devices. The apparatus can be used conveniently by persons without mechanical of electrical aptitude.

The control apparatus of the invention is simple in design and can be produced relatively inexpensively. Commercially available materials and components can be used in its fabrication employing conventional electrical manufacturing techniques and procedures.

The control apparatus can be installed easily after only a minimum of instruction. A wide variety of different electrical devices and appliances currently in use can be employed with the apparatus of the invention relatively quickly in only a few minutes. The apparatus can be modified easily to accommodate particular operating temperatures. The apparatus is durable in construction and has a long useful life with little if any maintenance.

It will be apparent that various modifications can be made in the particular control apparatus described in detail and shown in the drawings within the scope of the invention. The size, configuration and arrangement of components can be different to meet specific requirements. Also, the apparatus can be designed to accommodate electrical devices operating at particular temperature ranges as desired. These and other changes can be made provided the functioning and operation of the control apparatus are not adversely affected. Therefore, the scope of the invention is to be limited only by the following claims.

What is claimed is:

1. Temperature responsive control apparatus including a housing portion, a socket portion, a circuit portion, a temperature responsive portion, a connecting portion and a fastening portion; said housing portion including an enclosure member including a major face section and a plurality of sidewall sections extending from edges thereof, a cover section joining free edges of said sidewall sections and forming a chamber with said enclosure member, said enclosure member including divider sections extending from said major face section and said sidewall sections toward said cover section; said socket portion including a plurality of openings in said enclosure member; said openings being arranged into groups of at least two adjacent openings with each group providing a combination of openings mateable with an electrical plug member; said circuit portion including at least two spaced buss bar members, said buss bar members being disposed within said chamber of said enclosure member in a generally parallel relationship, each of said buss bar members including a contact section adjacent each end thereof extending in one direction therefrom toward said socket openings and terminating adjacent thereto, one of said contact sections that extends from one of said buss bar members being disposed adjacent a socket opening of each socket opening group and one of said contact sections that extends from another buss bar member being disposed adjacent a second socket opening of each socket openings group; said temperature responsive portion including bi-metal thermostat means, said bi-metal thermostat means being disposed within said chamber and having one contact thereof connected to one of said buss bar members; said connecting portion including positive and neutral contact terminals, a contact terminal extending from one of said buss bar members, and another of said contact terminals extending from a second contact of said bi-metal thermostat means; said contact terminals being arranged closely adjacent to each other, each of said contact terminals extending through said cover section; said fastening portion including fasteners securing said cover section to said enclosure member; whereby electrical current only moves through said control apparatus to energize electrical devices having plug members inserted into said socket portion when a threshold temperature of said bi-metal thermostat means is passed.

2. Temperature responsive control apparatus according to claim 1 wherein said housing portion is formed of plastic.

3. Temperature responsive control apparatus according to claim 1 wherein said enclosure member is a unitary structure.

4. Temperature responsive control apparatus according to claim 1 wherein said enclosure member has a quadrangular configuration.

5. Temperature responsive control apparatus according to claim 1 wherein each group of said socket portion includes three socket openings.

6. Temperature responsive control apparatus according to claim 5 wherein said three socket openings are arranged in a triangular configuration.

7. Temperature responsive control apparatus according to claim 1 wherein said buss bar members are retained by said divider sections.

8. Temperature responsive control apparatus according to claim 1 wherein said circuit portion includes three buss bar members.

9. Temperature responsive control apparatus according to claim 8 wherein said contact sections of said third buss bar member are disposed adjacent a third socket opening of each socket opening group.

10. Temperature responsive control apparatus according to claim 1 wherein said bi-metal thermostat means includes an insulator housing.

11. Temperature responsive control apparatus according to claim 1 wherein said said contact terminals have a blade configuration.

12. Temperature responsive control apparatus according to claim 1 wherein positive and neutral contact terminals are blade members arranged substantially parallel to each other.

13. Temperature responsive control apparatus according to claim 8 including a ground terminal extending from said third buss bar member.

14. Temperature responsive control apparatus according to claim 13 wherein said ground terminal includes are elongated cylindrical pin.

15. Temperature responsive control apparatus according to claim 1 wherein said fastening portion includes screws extending through said cover section into said divider sections.

* * * * *